United States Patent [19]

Linkletter

[11] Patent Number: 5,033,863

[45] Date of Patent: Jul. 23, 1991

[54] METHOD AND ARRANGEMENT OF A FLIGHT ATTACHMENT

[75] Inventor: Don R. Linkletter, Cedar Rapids, Iowa

[73] Assignee: Cedarapids, Inc., Cedar Rapids, Iowa

[21] Appl. No.: 618,680

[22] Filed: Nov. 27, 1990

Related U.S. Application Data

[63] Continuation of Ser. No. 475,677, Feb. 6, 1990, abandoned.

[51] Int. Cl.[5] ..... B01F 9/06

[52] U.S. Cl. ..... 366/228; 29/525.1; 366/25; 366/57; 432/118

[58] Field of Search ..... 366/228, 229, 225, 57, 366/58, 59, 25, 26, 24, 22, 23, 60; 68/144, 146; 134/119, 120; 432/118; 34/108, 179, 57 B, 57 R, 57 D

[56] References Cited

U.S. PATENT DOCUMENTS

| | | | |
|---|---|---|---|
| 1,363,561 | 12/1920 | Browne . | |
| 1,595,659 | 8/1926 | How . | |
| 2,261,403 | 11/1941 | Newhouse . | |
| 2,553,464 | 5/1951 | McNeill . | |
| 2,708,570 | 5/1955 | Manabe . | |
| 3,514,870 | 6/1970 | Avril . | |
| 3,910,756 | 10/1975 | Henning . | |
| 4,175,335 | 11/1979 | Avril . | |
| 4,307,520 | 12/1981 | Lutz . | |
| 4,569,659 | 2/1986 | Olsen et al. . | |
| 4,835,852 | 6/1989 | Asplund | 29/525.1 |

*Primary Examiner*—Robert W. Jenkins

*Attorney, Agent, or Firm*—Simmons, Perrine, Albright & Ellwood

[57] ABSTRACT

Flights in drums of drying and mixing apparatus are attached with bolts held by bolt cages disposed on inner surfaces of the drums. The bolt cages are formed of channels, the channel openings of which face the inner surface of the drums, and which channels have longitudinal slots extending from ends of the channels into the bases thereof for receiving the shanks of bolts. The bases or base plates are consequently spaced by side walls of the channels from the inner surfaces of the drums, the depth of the channels being such to admit the height of a head of a bolt between the inner surface of the drums and adjacent and facing surfaces of the bases of the channel type cages. The side walls of the cages extend parallel to the slots and are spaced to slidingly accept the width of the head of a bolt across opposite parallel faces of such bolt. The spacing between the sidewalls thereby prevents the rotation of a caged bolt about its longitudinal axis as a result of a nut being torqued onto its shank. The cages are preferably welded to the inside surfaces of the drums and releasably capture the heads of bolts inserted into the slots with the shanks of the bolts extending radially inward into the drums to engage correspondingly located apertures in flanges of flights to be attached. When an apertured flange of any such flight is inserted over respective cages and bolts, and is fastened to the cages by complementary fasteners, such as nuts, the profile of the cage in combination with a protective shielding by the flange of the attached flight substantially eliminates wear on the cages due to material contact as a result of the operation of a respective drum.

12 Claims, 1 Drawing Sheet

FIG 1
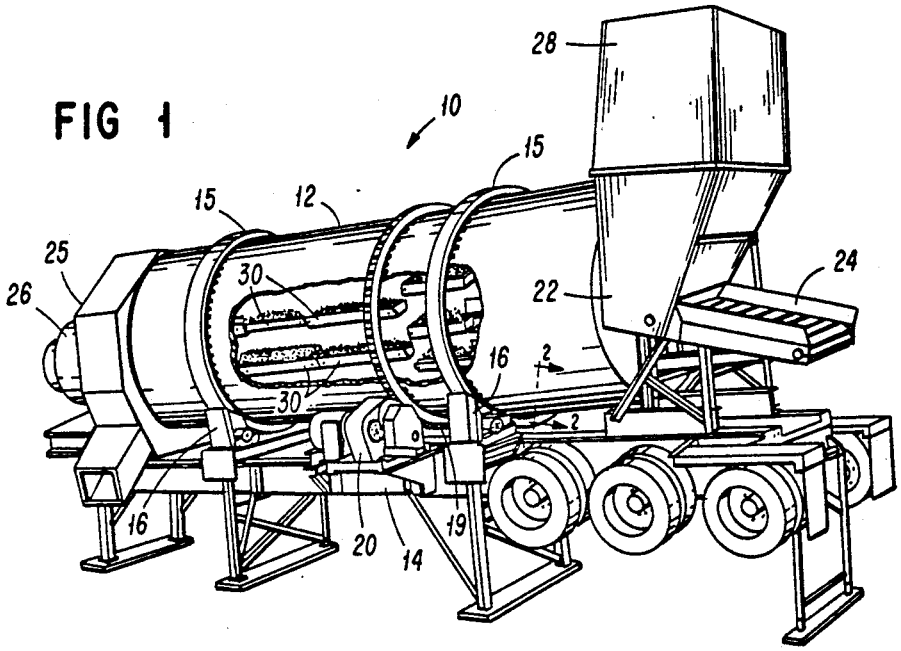
FIG 2
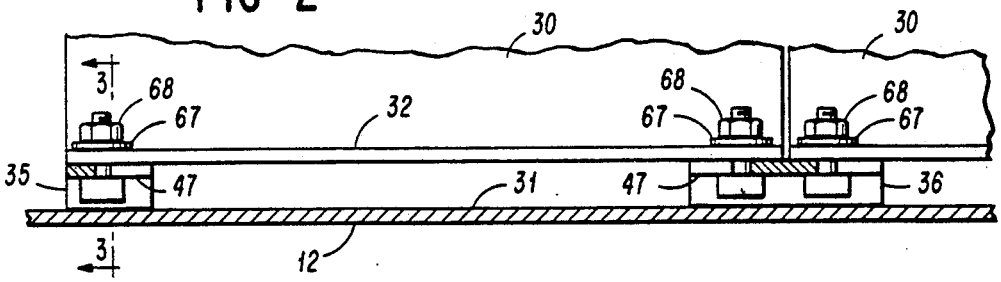
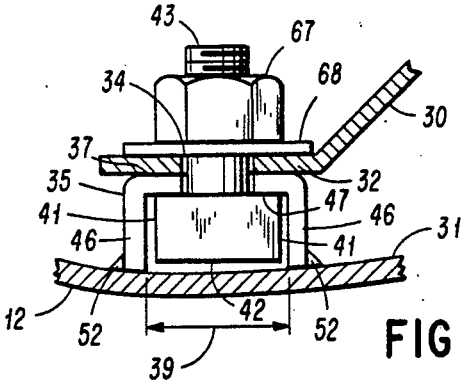
FIG 3
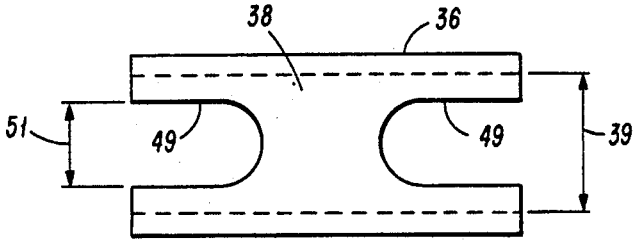
FIG 4
FIG 5
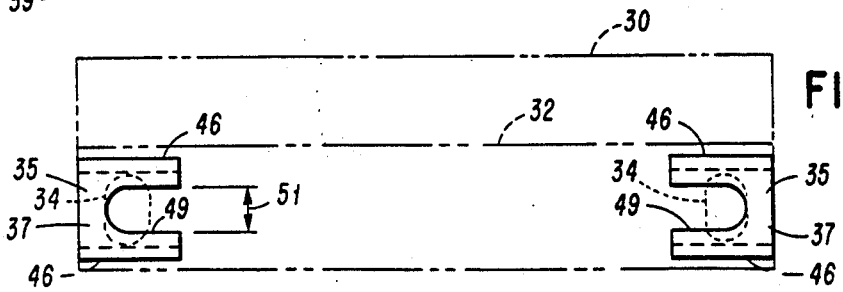

METHOD AND ARRANGEMENT OF A FLIGHT ATTACHMENT

This is a continuation of U.S. application for patent, Ser. No. 07/475,677, filed Feb. 6, 1990, now abandoned.

BACKGROUND OF THE INVENTION

1. Field of the Invention

The invention relates generally to the assembling and replacing wear parts in apparatus for processing bulk type materials, and particularly to attaching flights in material processing apparatus, such as mixing and drying drums. A particular use for the subject matter of the invention resides in mixing and drying apparatus used for manufacturing asphaltic type paving materials.

2. Discussion of the Prior Art

Asphalt mixing and drying drums are typically cylindrical drums which are operated in a generally horizontal position. Material, such as crushed stone aggregate is typically fed into one end of the drum, is heated, then typically mixed with asphalt in a downstream end of the drum and discharged from the drum. A heater at one end of the drum typically generates hot gases which flow through the length of the drum. Mixing the aggregate within the drum is achieved by rotating the drum about its substantially horizontal, longitudinal axis, thereby advancing and agitating the aggregate material. In advancing through the drum, the material is lifted by flights which are spacedly attached around the inner wall of the drum, then gradually released from the flights, either to fall in a curtain of material through a stream of the hot gases, or released over the tops of the flights in a swirling motion to mix with asphalt or with other aggregate materials. The type of action is typically determined by the type of flights attached to the inside walls of such drums.

It is readily realized that flights attached to the inside of such drums are exposed to extreme wear which is the result of abrasive, sliding contact with the material, as the material first falls against the lower ones of the flights, then slides across upper surfaces of the fights, as the drum rotates and the flights move through an upper arc of a complete revolution of the drum. Wear is particularly evident on inwardly extending portions of the flights, while the portions of the flights directly adjacent the inside wall of the drum tend to experience less wear. Within relatively short time periods, the flights become worn and need to be replaced with new ones. So-called downtime for maintenance of the drums is, consequently, a function to be reckoned with in considering the value of the drums. The time required for maintenance to replace worn sets of flights amounts to a corresponding period of time during which the respective apparatus is taken out of service and is not available for useful production of materials.

It is, consequently, desirable to reduce down-time for maintenance and thereby extend the time during which such drums are available for production. According to one known technique of attaching flights to the inside of drums, the flights are attached with bolts and nuts to ears or brackets which are typically welded to the inside walls of the drums. The brackets extend from the walls towards the interior of the drums. When time comes to replace the flights, the heads of the bolts are typically burned off with a cutting torch and the worn flights are then replaced with new ones. Though typically accumulating material at the juncture of the brackets and the drum wall shields the portions of the brackets which are directly adjacent the drum, inwardly extending portions of the brackets are nevertheless exposed to the abrasive movement of material just as the flights are, and are, hence, subject to a similar, high degree of wear. It is very likely that in short order, after the flights have been replaced a few times, major repair becomes necessary when the brackets have become worn to a point at which they will no longer securely hold new flights to the inside of the drums. It then becomes necessary to either cut the remaining brackets from the inside of the drums and replace them with new ones, or to rebuild the worn brackets with additional material thicknesses to rejuvinate them for further service.

Another known method of mounting the flights to the inside walls of the drums eliminates the need to replace or repair on a relatively frequent basis such above-described brackets. This is accomplished by providing flight assemblies with mounting ears or flanges extending substantially parallel of the wall of a respective drum. The mounting flanges have apertures which are 4 spaced to line up with correspondingly spaced mounting apertures in the drums. The flights are then mounted by bolts which extend directly through the wall of the respective drum. The bolts are fastened also in a typical manner with nuts. When it comes time to replace the flights, the flanges on the worn flights, extending flat against the apertures in the drums have protected the apertures against wear. The heads of bolts or the respective nuts on the inside of the drums are typically embedded in material accumulations adjacent the drum wall. Consequently, the bolts and nuts are still cut away with a cutting torch to release the worn flights. New flights are then aligned to the existing apertures to attach them to the drum in the same position as the just removed, worn flights.

In replacing the flights of the last-described flight assemblies, a problem exists in that two workers are required to accomplish the initial assembly or a replacement of the worn flights. One worker aligns the flights to the existing apertures in one of the drums and either sticks a bolt through the aperture in the mounting flange of the flight and the aligned aperture in the drum, while a second worker attaches and tightens a nut on the outside of the drum. In the alternative, the bolt is inserted from and held in place on the outside of the drum by one worker, while the second worker attaches the flight and tightens a nut over the inner end of the bolt extending into the drum from the outside.

It is, hence, desirable to devise a mount and a related method of mounting which eliminates some of the cumbersome procedures of assembling or changing flights in a drier-mixer drum.

SUMMARY OF THE INVENTION

It is an object of the invention to provide new and useful mounts for attaching flights to the inside of drums of apparatus used in the processing of materials, such as asphaltic composition materials for pavements and the like.

It is another object of the invention eliminate a need for fastening flights through the wall of drums.

It is a further object to provide a type mount for attaching flights to inside walls of aggregate drier drums, which type is at least partially protected from wear.

According to the present invention, a mounting provision for attaching flights includes a mounting cage forming a channel having a base and two spaced, parallel legs extending from the base. The base has at least one slot extending from at least one end of the channel toward the center of the base, the slot having a predetermined width for accepting the shank of a bolt. The legs are spaced to receive the width of a head of a bolt between adjacent surfaces and have a height in excess of the height of the head of the bolt.

Various advantages and features of the invention will become apparent from a description thereof in reference to a preferred embodiment thereof.

BRIEF DESCRIPTION OF THE DRAWINGS

The Detailed Description of the Invention including a detailed description of a preferred embodiment thereof will be best understood when read in reference to the accompanying drawings wherein:

FIG. 1 shows a pictorial, though somewhat simplified cut-away view of a typical drum drier as an example of apparatus to which the invention applies;

FIG. 2 is a partial sectional view of a drum of the apparatus shown in FIG. 1, showing flight attachment cages in accordance with the present invention;

FIG. 3 is an end view of one of the flight attachment cages shown in FIG. 2, the end view illustrating the manner in which a bolt for attaching flights is captured by a channel-like shape of the attachment cage:

FIG. 4 is a top view of an alternate shape of the cage, shown to illustrate a variation for mounting flights adjacent to each other; and FIG. 5 is a top view of a pair of the cages, showing a preferred arrangement for mounting the cages for capturing bolts for attaching flights at each end of the respective flight.

DETAILED DESCRIPTION OF THE INVENTION

Referring now to FIG. 1, there is shown a cut-away view of a drum drier designated generally by the numeral 10. The drum drier 10 is a typical piece of apparatus to which the present invention advantageously applies. A drum 12 of substantial size constitutes a major working component of the drum drier. The drum 12 is substantially horizontally supported above and with respect to a frame 14. Depending on the size of the drum 12 two or more tires 15 are mounted around the periphery of the drum 12. The tires 15 are centered on and spaced along the longitudinal axis of the drum 12 to support the weight of the drum 12 and any material being processed within the drum. The tires 15 ride on sets of trunnions within typically shielded trunnion assemblies 16. The trunnion assemblies 16 are mounted on outrigger-type frame assemblies 17 which are disposed transversely to the frame 14. One or more toothed wheels 18 are mounted circumferentially about the drum 12. The wheels 18 are driven elements and engage, on the underside of the drum 12, a drive chain 19 of a typical saddle chain drive 20 which is transversely disposed across the frame 14 to rotate the drum of the drum drier about its longitudinal axis.

In the operation of the drum drier 10, material is typically fed into a first or feed end 22 of the drum 12 by a feeder conveyor 24, such as the slinger conveyor shown in FIG. 1, or by other feed means, as desired. Depending on whether the apparatus is a parallel flow or counterflow apparatus, the same end 22 or an opposite end 25 features an axially directed burner unit 26. The burner unit 26 is fired during the operation of the drum drier 10 to generate hot gases which typically flow from such burner end through the drum 12 and are typically drawn from the drum 12 to post-filtering or exhaust processing equipment via an exhaust box 28.

A cut-away view of portions of the drum 12 shows the location of flights 30 as they are substantially evenly distriputed along substantially the entire inner surface 31 of the drum 12. Flights are used in various shapes and configurations. Certain configurations of the flights 30 are particularly suited to advance material, such as aggregate materials, through the drum 12. Other types of the flights 30 are shaped in accordance with known practices to lift the material with the rotation of the drum 12 along the ascending inner wall thereof, and to gradually release the lifted material as it is advanced through an upper arc of the rotational path of the drum 12. The material is thus dropped in a curtain-like pattern across the inner space encompassed by the drum 12. Thus, in falling through the inner space of the drum, the material becomes exposed to the heated gases generated by the burner unit 26 and is dried and heated as desired.

The flights 30 are by design intent the working tools of the drum 12 in that they implement the desired movement of the material moving through the drum 12. The shape of the flights 30 may vary substantially depending on the desired arc through which the material is to be moved, and whether the material is intended to be dropped slowly to form a curtain of material, or whether the material is to swirl and mix with liquid asphalt or other aggregate material. Independently of the shape of the flights 30 related to their designated function, each of the flights 30 typically features a flange 32 which is disposed adjacent an inner surface 31 of the drum 12. The flanges 32 are mounting flanges and include to that extent typical apertures in the form of holes or slots 34 by which the flights 30 are to be mounted or attached to the inner surface 31 of the drum 12.

Referring to the partial, sectional view into the drum 12, as illustrated in FIG. 2, the flights 30 are attached to the inner surface 31 of the drum 12, in accordance with features of the invention, by means of mounting cages 35 and 36. The mounting cages 35 and 36 are in a radial direction of the drum 12 shielded by the flanges 32 of the flights 30. In a direction of rotation of the drum along the cylindrical inner surface 31 of the drum 12, the cages 35 and 36 present a small exposure because of their low profile. Thus, the cages 35 and 36 remain substantially shielded from abrasive wear by aggregate materials. The structure of a preferred embodiment of the cages 35 and 36 is that of formed steel channels. Major elements of the cages 35 and 36 are first of all the mounting surfaces formed by base plates or bases 37 and 38, respectively. The bases 37 and 38 have an inner width 39 (as shown, for example, in the end view of FIG. 3) substantially of the width across opposite flats 41 of a head 42 of a mounting bolt 43. The end view of FIG. 3 further shows a channel-like cross-sectional shape of the mounting cage 35, which is desirably identical to the cross section of the cage 36. The cross-sectional shape of the cages 35 and 36 are formed by two spaced side walls 46. According to the preferred embodiment described herein, the side walls 46 are parallel, spaced by substantially the width between opposite flats 41 of the head 42 of the bolt 43. The side walls 46 have a height from an inner surface 47 of the bases 37 and 38, spacing the bases from the inner surface of the drum 12 by a distance sufficient to admit the height of the head 42 of the mounting bolt 43 between the bases and adjacent inner surface of the drum 12. The side walls 46 consequently locate the bases 37 and 38 substantially parallel to the immediately adjacent portion of the drum 12, disregarding because of the size the cylindrical shape of the drum. It is realized that the cage may take another, similar form, differing from the preferred embodiment described herein. For example, the side walls 46 may take a different shape, may constitute a single side wall perpendicular from the bases 37 or 38, or there may be more than the described pair of opposite, parallel side walls. However, the currently preferred embodiment of the channel-like cross-sectional shape has been found to be comparatively efficiently manufactured from flat stock of material, for example.

In the preferred embodiment, the mounting cages 35 and 36 are formed of a unitary piece of steel, such as hot rolled steel. The side walls 46 are bent at a right angle with respect to the base 38 to form in conjunction with the base the channel-like cross section of the cages 35 and 36. The opening of the channel, of course, faces the inner surface 31 of the drum 12, as the cages are attached to the inner surface. Seen in the end view in FIG. 3, the side walls 46 function as stand-offs or legs for the base 37 and of course also for the base 38. Also, the side walls 46 form together with the respective bases 37 and 38 and the adjacent inner surface 31 of the drum 12 restrictive limitations of movement to restrain the head 42 of the bolt 43. In reference to FIGS. 4 and 5, which show a top view of the mounting cages 36 and 35, respectively, slots 49 are formed from at least one edge of the cages 35 and 36 in the longitudinal direction of the channel into the base 38. The slots 49 extend from their open end at the respective edge into the base and are oriented that the side walls 46 extend parallel to the length of the slots 49. For facing inner surfaces of the side walls 46 to restrict the rotational freedom of movement of the bolt 43 after such bolt has been inserted into the respective slot 49, the slots are centered between the sidewalls. The slots 49 have a width 51 which accommodates the diameter of the bolt 43, namely its shank, as can be seen in the end view of the cage 35 in FIG. 3.

As is also shown in FIG. 3, the mounting cages 35 are preferably permanently attached and made part of the drum 12 by welding outer edges of the side walls 46, such as by fillet welds 52, at predetermined locations to the inner surface 31 of the drum 12. It should be realized that welding is disclosed as a preferred manner of attaching the cages 35 and 36 to the drum 12. Other ways of attachment are possible, such as bolting the cages to the drums. Welded to the drum 12 in the manner shown in FIG. 3, the cages, such as the cage 35, present a low profile in the direction of the rotation, hence, the cages lie closely to the inner surface 31 of the drum 12. It appears, that it is in such boundary regions of the drum 12, immediately adjacent the inner surface 31 of the drum 12, that material tends to accumulate or be subject to less movement than material located more toward the center of the drum. Furthermore, when the flight is mounted to the cage 35 as shown in FIG. 3, the flange 32 of the flight 30 shields the base 38 of the cage 35 from direct impact of abrasive material within the drum 12. In many instances, flights 30 may extend from the mounting cages 35 and 36 to both the leading and the trailing directions of the drum 12, with respect to its intended rotation. The low profile of the side walls 46 of the cage 35 retains the structural effect that exists when flights are mounted directly to the inner surfaces of drums, namely to form pockets between the flights 30 and the inner surface 31 of the drum 12, the side walls 46 of the cages being at the apex of such pocket. The pockets further the referred to tendency to accumulate and retain a certain amount of the material adjacent the inner surface of the drum, which accumulated material protects the side walls 46 of the mounting cage 35.

Particularly with respect to flange-mounted flights 30, attaching the flights 30 to the inner surface 31 of the drum 12 through the intervening cages 35 and 36, hence spacing the flights 30 from the drum 12 by the height of the side walls 46 tends to reduce a disadvantageous condition that has been contended with in view of the other advantages of flange-mounted flights 30. The cages 35 and 36 now isolate the flanges 32 of the flights 30 from direct contact with the inner surface 31 of the drum 12. Only the cages 35 and 36 provide-contact between the flights 30 and the drum 12. Such contact is in comparison to the entire surface of the flange 31 quite small. When in direct contact with the inner surface 31 of the drum 12, as in accordance with prior art practices, the flights act as heat conductors, receiving in the interior of the drum 12 direct heat from the hot gases generated by the burner unit 26, and directing the received heat energy through the flanges 32 to the drum 12. The result is that the surface of the drum 12 tends to overheat and to transmit the heat to outer driving and other operating components, presenting problems from the wear and safety standpoints. As spaced from the inner surface 31 of the drum 12, the flights 30 are usable as heat shields to protect the drum 12 from receiving excess heat energy from the hot gases inside the drum. In areas directly adjacent the burner flame, the flights 30 not only transmit less heat to the drum 12 by reduced conductive transfer, but become further useful in shielding the drum 12 from receiving energy in the form of radiation from the flame. The result appears to be increased safety from lower temperatures on the outer surface of the drum 12, less resulting wear from overheating in operating components such as drives and supports, and also increased heat efficiency leading to a possibly more efficient operation of the apparatus 10 from an energy usage standpoint, in that less heat is radiated to the environment from the drum 12.

FIG. 5 shows a preferred manner of locating and mounting the mounting cages 35 on the inner surface 31 of the drum 12. As viewed in a plan view, radially outward toward the inner surface 31 of the drum, the cages 35 also resemble a "U"-shape. The open end of the "U" is formed by the open end of the slot 49. In a preferred arrangement for attaching a flight to the inner surface 31 of the drum 12, at least a pair of the mounting cages 35 are disposed and welded to the drum 12 with their respective slots 49 in alignment. One of the cages 36 may be interposed between two outer cages 35. According to the preferred arrangement, open ends of the slots 49 at ends of such selected pair of adjacent cages 37 or 38 are directed toward each other, hence, the slots 49 of such two adjacent cages 35 face each other. The spacing between such adjacent two brackets is such that the distance between two correspondingly adjacent bolts 43 in their nominally fully inserted positions in the slots 49, thus adjusted outwardly away from each other, corresponds to the nominal center distance between two adjacent apertures 34 in the flange 32 of the flight 30. Such preferred arrangement of the mounting cages 35 shields the slots 49 from exposure and wear which might occur with the respective cages 35 being located near an outer end of each such flight 30. Also, the inward-facing openings of the slots 49 further the concept of caging the bolts 43. Thus, when respective bolts 43 are inserted with their heads 42 into the slots 49 and respective apertures 34 in the flanges 32 are placed over the inward extending end or shank of the captured bolt 43 and fastened, for example as shown, by a nut 57 fastened against a washer 58 (see FIG. 3), to tighten the respective flight 30 against the respective base plate, the bolts are then fully caged. Placing the nuts 57 onto or over the ends of respective threaded shanks of the bolts 43 and torquing or tightening the nuts 57 on the bolts. 43 securely attaches the flights 30 to the cages 37 and 38. Thus, even if an impacting force from the material should exert a blow longitudinally against the flight 30, the closed outer ends of the cages 35 capture the flight 30 securely. The apertures 34 in the flights furthermore retain the bolts 43, such that the bolts are substantially protected from becoming dislodged from the mounting cages 35.

The mounting cage 36 shown in its top view in FIG. 4, and in an elevational sectional view in FIG. 2, is particularly intended for mounting the ends of two adjacent flights 30. In essence the mounting cage 36 resembles and is the equivalent of two mounting cages 35 which are aligned by abutting engagement of their non-slotted ends. As shown in FIG. 2, an outer end 61 of the left-most flight 30 is mounted in the already described manner to one of the mounting cages 35. A right-hand end 62 of the same flight 30 is shown as being mounted adjacent a left-hand end of a second flight 30. It may be deemed desirable, though not necessary, to establish in some flight arrangements alignment between the two adjacent flights 30 by attaching the adjacent ends of the flights 30 with a single cage 36. As shown in FIG. 4, the cage 36 features a slot 49 in each end of the base 38, such that the respective ends of both of the flights 30 can be attached to the drum 12 in alignment with each other. A described with respect to the cage 35, the base 38 of the cage 36 is also shielded from abrasive exposure to material by the two adjacent ends of the flights 30.

As a specific example of the preferred embodiment of the invention described herein, a preferred size of the cage 35 is an inner spacing between the side walls 46 one and three eighths of an inch, a width of the slot 49 of thirteen sixteenths of an inch to accept a bolt 43 which is three quarters of an inch in diameter. The channel length or longitudinal extent of the cage is approximately two inches. The depth of the slot 49 from the end of the cage 35 is preferably such that the bolt 43 is locatable at the center of the mounting cage 35. The depths to which each of the slots extend toward the center of the cage 36 is also such that the bolts 43 can be located one inch from each end of the cage 36. A preferred length of the cage 36 is, hence, four inches. A preferred material thickness for both the walls and the base of l the cages 35 and 36 is one fourth of an inch.

A preferred height of the mounting cages 35 and 36 is one inch. This means that the flights 30 are spaced by a distance of one inch away from the drum. As discussed, some material being lifted by the flights tends to accumulate in the space between the inner surface of the drum 12 and the mounted flights, particularly adjacent the cages 35 and 36. Such buildup of material has the described, apparent effect of shielding the edges of the flights as well as the mounting cages 35 and 36 from the abrasive movement of the material as the drum processes the aggregate in the desired manner. The cages 35 and 36 for the heads of the bolts 43 are shielded in addition by the flanges 32 of the flights 30. Edges do not extend from the mounting cages 35 and 36 into the interior of the drum 12, in that the side walls 46 are welded as described to the inner surface 31 of the drum 12.

With respect to the disclosed mounting cages 35 and 36, the removal of worn flights 30 is accomplished by burning or cutting the nut 57 and typically the inward extending portion of the respective bolt 43. Once that is accomplished at both ends of the worn flight 30, in reference to FIG. 5, for example, the respective flight can be removed, releasing the up to then caged head 42 and adjacent end of the bolt 43. It then becomes a relatively simple matter to replace the cut portions of the bolt 43 with a new bolt and insert a new flight 30 over the respective bolts 43. It should be noted that all functions attending to the replacement of the flight can be performed by a person working on the inside of the drum 12.

Various changes and modifications in the structure of the described embodiment are possible without departing from the spirit and scope of the invention which is sought to be defined by the full scope of the terms of the claims appended hereto and their reasonable equivalents.

What is claimed is:

1. A method of mounting flights to an inner surface of a drum of apparatus for processing aggregates, the method comprising:

forming a plurality of fastener cages on an inside surface of the drum, each cage including means for capturing the head of a fastener adjacent the inside surface of the drum and a fastening axis of the fastener extending substantially radially inward;

inserting a plurality of fasteners with respective heads into captured positions in the cages;

placing apertured flanges of flights with apertures into alignment with the inserted fasteners and over the inserted fasteners and cages; and fastening the flanges of the flights by means of the inserted fasteners to the cages, whereby the flanges protect the cages from abrasive action of aggregate material during the operation of the apparatus.

2. A method according to claim 1, wherein:

forming a plurality of fastener cages comprises forming a plurality of bolt cages on an inside surface of the drum, each cage including means for releasably capturing a bolt with the head of the bolt adjacent the inside surface of the drum and a shank of the bolt extending substantially radially inward;

inserting a plurality of fasteners comprises inserting a plurality bolts into captured positions in the cages with heads of the bolts disposed adjacent the inside surface of the drum and shanks of the inserted bolts extending radially inward of the drum;

placing apertured flanges of flights comprises aligning the apertures in the flanges of the flights with the inserted bolts, placing apertured flanges of flights over the cages such that the shanks of the inserted bolts extend through the apertures, thereby capturing the bolts further by the lateral confines of the apertures in the flanges; and fastening the flanges of the flights comprises placing nuts over the shanks of the bolts and tightening the nuts on the shanks to fasten the flanges of the flights against radially inward facing surfaces of the cages.

3. A method according to claim 2, wherein forming a plurality of bolt cages on an inside surface of the drum comprises:

positioning a plurality of channel sections at predetermined locations on the inside surface of the drum, each of the channel sections having a base including a laterally open slot and a pair of side walls extending from the base at an angle from the base, such that the side walls space the base from the inside surface of the drum; and fastening the channel sections at such predetermined locations to the inside surface of the drum.

4. A method according to claim 3, wherein fastening the channel sections at such predetermined locations comprises welding the outer edges of the side walls of the channel sections to the inside surface of the drum.

5. A method according to claim 3, wherein positioning a plurality of channel sections comprises locating the channel sections pairwise with the laterally open slots facing one another, thereby shielding such laterally open slots laterally by inward facing orientation beneath the flange of a respective one of the flights.

6. An arrangement for attaching a flight to an inner surface of a cylindrical material processing drum, the flight having a flange adapted to be mounted by fasteners to the inner surface of the drum, the drum being operationally rotatable about a horizontally disposed longitudinal axis, the arrangement comprising:

at least one cage for capturing and orienting an axially threaded fastener with its threads disposed along an axis in a radially inward direction of the drum, the cage including a base plate having at least one slot extending from an open end at an edge of the base plate into the base plate for receiving in such slot an axially threaded member of the fastener; and means for locating the base plate adjacent an inner surface portion of the drum substantially parallel with respect to such inner surface portion and spaced therefrom by a distance sufficient to receive a head of the threaded fastener and for engaging the head of such fastener to capture the fastener against axial rotational movement and movement in the radial direction of the drum.

7. An arrangement according to claim 6, wherein the means for locating the base plate comprises at least one side wall extending from a surface of the base plate facing the inner surface of the drum.

8. An arrangement according to claim 7, wherein the at least one side wall comprises a pair of spaced side walls, the side walls extending parallel to the length of the at least one slot on both sides of thereof, the at least one slot being centered between the side walls.

9. An arrangement according to claim 8, wherein the fastener is a bolt, the at least one slot in the base plate slidably admitting a threaded shank of the bolt, the base plate and side walls capturing the head of such bolt between adjacent surfaces of the base plate and the drum and the shank of the bolt extending radially inward of the drum, the flange of the flight being apertured, including at least on aperture for receiving the shank of such bolt, the flange being engageable with the cage such that when the flight is attached to the inner surface of the drum, the aperture is aligned with the shank of the bolt and captures the bolt, restricting its further movement toward the open end of the slot.

10. An arrangement according to claim 9, wherein the at least one cage comprises at least two cages, the at least two cages being mounted to the inner surface of the drum with the open ends of the slots in respectively adjacent cages being directed mutually toward each other, the at least two adjacent cages being spaced that the distance between two correspondingly adjacent bolts being fully inserted into the adjacent slots of the adjacent cages correspond to the spacing between two apertures in the flange of the flight to be mounted to the respectively adjacent cages.

11. An arrangement according to claim 10, wherein the cages include at least one cage having at least two slots extending from opposite ends into such cage.

12. An arrangement for mounting a flight on the inside of a drum, comprising at least one pair of bolt cages, each cage having a base including at least one slot extending from an edge of the base into the base, and a pair of side walls extending at an angle with respect to the base and substantially parallel to the slot, one on each side of the slot, the side walls extending from the base toward the inner surface of the drum, spacing the base from the inner surface of the drum to allow a head of a fastener to be inserted into such slot between the inner surface of the drum and the adjacent surface of the base, such bolt cages being mounted to the drum spaced such that adjacent slots in the respective pair of bolt cages are spaced by a distance equal to the spacing of mounting apertures on a flange of a flight, such that bolts inserted into such slots with respective heads between such bases and the inside surface of the drum become aligned with the respective apertures in the flange of the flight and upon the flight being placed over the bolt cages with shanks of the respective bolts extending through the apertures in the flange of the flight are captured by the cages and the flights attached to the drum by the bolts.

* * * * *